US005980322A

United States Patent [19]

Madsen et al.

[11] Patent Number: 5,980,322

[45] Date of Patent: Nov. 9, 1999

[54] ELECTRICAL CONNECTOR HAVING A FUSIBLE LINK FOR USE BETWEEN MEDIA CONNECTORS AND COMPUTER COMMUNICATIONS CARDS

[75] Inventors: Brent D. Madsen; Gordon Crawford, both of Salt Lake City, Utah

[73] Assignee: 3Com Corporation, Santa Clara, Calif.

[21] Appl. No.: 09/144,898

[22] Filed: Sep. 1, 1998

[51] Int. Cl.[6] ..... H01R 13/68

[52] U.S. Cl. ..... 439/621

[58] Field of Search ..... 439/621, 131, 439/946.2

[56] References Cited

U.S. PATENT DOCUMENTS

| | | | |
|---|---|---|---|
| 5,034,846 | 7/1991 | Hodge et al. | 361/119 |
| 5,183,404 | 2/1993 | Aldous et al. | 439/55 |
| 5,227,759 | 7/1993 | Hatagishi | 337/260 |
| 5,444,428 | 8/1995 | Carr et al. | 337/188 |
| 5,505,633 | 4/1996 | Broadbent | 439/329 |
| 5,775,951 | 7/1998 | Gargiulo | 439/640 |
| 5,810,622 | 9/1998 | Chang | 439/622 |

*Primary Examiner*—Paula Bradley
*Assistant Examiner*—Truc T Nguyen
*Attorney, Agent, or Firm*—Workman, Nydegger & Seeley

[57] ABSTRACT

An improved electrical connector for use in both a communications card or a communication or computing device for fusibly interfacing between a media connector and a downsized computer or communication device is provided. In a first embodiment, the communications card comprises a retractable access portion and a fixed portion. In a second embodiment, the fixed portion is a communication or computing device without an intermediary communication card. The retractable access portion has an aperture formed therein configured to receive the media connector. A fusible link is formed by a fusible pin block which includes a conductive terminal having a first and a second end mates with both the retractable access portion and the fixed portion. The first end makes electrical contact with the media connector while, simultaneously, the second end slidingly makes electrical contact with the fixed portion as the retractable access portion is extended beyond the computer housing during use. The conductive terminal has a fuse region within the pin block that can be formed by necking-down the conductive terminal to create a current restriction. Alternatively, a fuse material having fixed fusing characteristics may electrically bridge a first end portion and a second end portion of the conductive terminal. The fusible link protects equipments and persons from spurious electrical conditions introduced into the communications card via the media connector.

31 Claims, 7 Drawing Sheets

ELECTRICAL CONNECTOR HAVING A FUSIBLE LINK FOR USE BETWEEN MEDIA CONNECTORS AND COMPUTER COMMUNICATIONS CARDS

BACKGROUND OF THE INVENTION

1. The Field of the Invention

The present invention relates generally to the interface between physical/electrical media connectors and a communications card in a computer system and to communication devices capable of receiving a media connector. More specifically the present invention relates to an improvement in the electrical connection therebetween.

2. The Relevant Technology

The field of transmission of data by phone lines or network cables is a rapidly expanding field. Users of personal computers in particular are finding such practice to be of great value.

For example, there are numerous public and private networks and databases which store data or programs. Absent the ability to send and receive data over telephone lines through a modem, a user is relegated to relying upon the exchange of discs or tapes in order to receive data suitable for use with their computer.

Similarly, companies performing tasks that are integrated are aided by local area networks ("LANs") which permit personnel to exchange electronically retrievable data. The ability to freely transfer data and information from one computer to another computer over a telephone line may dramatically increase productivity and reduce overall production time.

To translate the binary code utilized by a computer into signals capable of being transmitted over the telephone lines, modems have been developed to translate and reconfigure binary signals into analog signals capable of being transmitted over telephone lines. For conversion of signals to take place, a modem must be placed between the computer generating the binary signals and the telephone line capable of carrying the analog signals.

Typically, in today's practice, a modem at the transmitting computer end of a telephone line receives binary digital data from the computer and converts the binary code received from the computer into modem frequency signals. These modem frequency signals are then transmitted over the telephone lines to a receiving modem at the receiving computer.

The modem at the recipient's end then converts the modem frequency signal back to binary digital data characters and inputs the data characters to the input port of the receiving computer.

As today's modems serve to provide a compatible interface between the phone lines and the computer, the Federal Communications Commission ("FCC") and telephone companies require an interface to moderate all signals or energy being input into the phone lines. This interface protects the phone lines and systems from damage, thereby ensuring the integrity and quality of transmissions over the phone lines.

A required part of this interface is a Data Access Arrangement ("DAA") circuit. The DAA circuit provides an impedance match and also serves to isolate the modem and the computer from transient signals and other disturbances coming in over the phone line. The DAA also protects the phone line from disabling influences emanating from the computer or the modem.

For example, damage would occur to the telephone system if instead of transmitting frequency signals, DC power was transmitted over the phone lines. Because the modem is attached directly to the phone line, the modem must incorporate the required FCC interface and must comply with any requirements imposed by local telephone companies.

The ubiquity of the telephone and the need for interactive systems throughout the world have caused standards to be established for the components of a telephonic system. Standardization allows telephone systems and devices using those systems to be interchangeable. The components of the telephone that are most thoroughly standardized are physical/electrical media connectors.

Physical/electrical media connectors are used by almost all telephone companies throughout the world for many applications, the most important of which is interconnection of telephones with telephone lines. For this reason, stringent standardization of connectors is required if compatibility and interactivity is to be realized.

One popular physical/electrical media connector used in the United States of America is the RJ-11 4-position miniature modular plug physical/electrical media connector. The RJ-11 is used between the telephone line and the telephone itself Unfortunately, because of the physical and electrical differences between the many pins of the peripheral ports associated with the central processing unit of a computer and the 4 pins of the RJ-11, direct physical or electrical connection of the RJ-11 to the computer is not possible.

Consequently, it has been found necessary to employ modems or similar input/output devices or cards to effect communication between computers and telephone lines. Modems reconfigure binary data from the central processing unit of the computer as received through the multi-pin peripheral port. The reconfigured data is then transmitted in analog form through the RJ-11 physical/electrical media connector into the telephone line.

In contradistinction to the development of telephone lines, transmission lines used in LANs have been developed specifically for the transmission of computer generated signals. Because of the recent development of these transmission lines, a variety of internal configurations for transmission lines have been developed to accomplish the transmission of computer data between computers.

A typical local area network comprises several computers at remote locations throughout a building interconnected with unshielded twisted pair cable utilizing RJ-type physical/electrical media connectors. The network is typically connected to a file server. A file server is a computer providing shared access to a file system, printer, electronic mail service, or modem. The file server is a combination of hardware and software that contains files shared by everyone connected to the LAN.

As LANs utilizing unshielded twisted pair cable are capable of transmitting signals at a higher rate than signals traveling through telephone lines, the requirements of the devices used to translate and reconfigure signals from the computer for transmission through lines have consequently been developed with different requirements.

The counterpart to the modem in telephonic communications is the LAN adapter card or data communications card. In a similar fashion to a modem, these communications cards reconfigure the parallel data produced by the computer into a serial form and back. These cards also provide buffering, encoding and decoding, cable access, and transmission.

As the use of LANs increases, it has become increasingly more beneficial for users of portable computers to have the ability to interact with several local area networks at different locations. For example, information at one location may be downloaded to a portable computer that allows a user to manipulate the data during a business trip and load the manipulated data onto the network at a destination. Diagnostics and maintenance are also made easier through the use of common connectors.

As the popularity of twisted-pair cable has increased, the popularity of the most frequently used physical/electrical media connector, the 8-pin miniature modular plug, has also increased. This increase in popularity of the 8-pin miniature modular plug has introduced the same problems and solutions into LANs as will be discussed regarding the RJ-11 physical/electrical media connector in the development of modems.

Many modems in use today are configured as external accessory units, housed in their own cases, and attached to the computer. Typically, external modems are electrically connected to the telephone with a telephone extension line utilizing physical/electrical media connectors at each end. External modems are often employed by users of personal computers because they can easily contain a substantial amount of electronic circuitry or hardware, as well as executable programs or software.

With the advent of downsizing technology in computer components, however, smaller portable computers (often referred to as laptop or notebook computers) have taken the place of many of the desktop models which use external modems. With the new-found portability available with laptop or notebook computers, the size of external modems has proved cumbersome and been rendered obsolete in keeping with the portability that buyers of these downsized computers desire.

To overcome the inconvenience and physical limitations of external modems, smaller modems have been developed that are small enough to be built integrally within the housing of a portable computer. As a result, integral internal modems that interface with the ubiquitous RJ-11 system provides users of portable computers with internal modems having a uniform standard interface for media access devices such as modems. Now, modem manufacturers can build products capable of accepting the RJ-11 media connector with confidence that their product can be used in a wide geographical area. Because modems can be built to the RJ-11 uniform standard, consumers benefit from the ability to interchange and interconnect media access devices without the need for adapters for products made by different manufacturers.

As computer housings have continued to be downsized, internal spatial restrictions have required the establishment of standards for the internal accessories of the computer. One set of standards applicable to memory cards has been developed by the Personal Computer Memory Card International Association (PCMCIA). This organization is comprised of hundreds of manufacturers of memory cards and related peripheral equipment. By convention, the PCMCIA has determined that the spatial standard for all memory cards used in down-sized computers should be restricted to a rectangular space approximately 55 mm in width, 85 mm in length, and 5 mm in depth.

In keeping with the PCMCIA standards for memory cards, internal modem manufacturers have adopted the same spatial standards for use with their down-sized communications cards such as a communications card 12 of FIG. 1. By complying with the standards established by PCMCIA for memory cards, communications card manufacturers have assured themselves of compatibility and spatial conformity with a computer 10 utilizing the new PCMCIA standards.

The constraints imposed by this new PCMCIA standard have resulted in the development of "credit card" communications cards. Most of the components formerly housed within a modem are now contained within a credit card-sized device. Although many of the communication cards serve the functions of a modem, a similar card has been contemplated for use in LANs. Nonetheless, the problem will hereinafter be addressed in terms of the PCMCIA standard communications card.

Since the depth of a PCMCIA standard communications card is limited to 5 mm and the depth of a typical media connector, such as the RJ-11 type or 8-pin miniature modular plug, is approximately 8–12 mm, the typical media connector exceeds the depth restrictions imposed by the PCMCIA standards for internal computer components.

While many prior art devices have tried to solve the depth incompatibility problem between the PCMCIA standard communications card and the media connector, a "pop-out" or sliding interface device 14 has emerged as a popular solution. The pop-out interface device, known commonly as the XJACK® initially produced by MEGAHERTZ Corp., now owned by 3 Com Corp., solves many of the interface problems posed by prior art devices. Such solved problems include, but are not limited to: (i) the elimination of carrying along an extra interfacing device compatible with both the media connector and the PCMCIA communications card; (ii) the elimination of ensuring a DAA in the interfacing device is compatible with the computer; (iii) the elimination of physical interference between adjacent PCMCIA communication cards in adjacent slots when the PCMCIA communication card has an enlarged portion thereof larger than the conventional 5 mm thickness; (iv) the elimination of potential breakage of the interface connector when not in use; and (v) the elimination of protrusions beyond the normal dimensions of the computer so that the computer portfolio is more compatible with devices typically transporting laptop computers.

With reference to FIG. 2, a typical embodiment of a sliding interface device in the form of a conventional 5 mm thick PCMCIA-architecture style communications card for directly interfacing with a media connector is depicted generally as 20. The communications card 29 defining the interface device 20 has a retractable access portion 22 and a fixed portion 24.

The fixed portion 24 is in electrical communication with a computer (not shown) by means of electronic circuitry connected on a printed circuit board (PCB) housed internally within the communications card 29. For brevity, fixed portion 24 may sometimes be referred to as the PCB 24 although the fixed portion includes more than just the PCB and electronic circuitry. The retractable access portion 22 is in electrical communication with the fixed portion 24 through a flexible wire ribbon 30. During use, in means well known in the art, the retractable access portion 22 slides in and out of a slot 32 formed within the PCB 24. The retractable access portion 22 is urged out of the slot 32 by a spring 34 biased, in a direction external to the computer housing, by a ledge 36 connected to the PCB 24. Although not shown, the computer housing during use is substantially parallel to an edge 37 of the communications card 29. A limiting notch 42 engaged by a biased lever 40 is used to restrict the travel distance of the interface device to a predetermined distance when the retractable access portion is urged in a direction external to the computer housing by the spring 34. After use, a retention notch 38 in combination with the biased lever 40 is used to retain the retractable access portion 22 within the housing of the computer.

An aperture 44 having a plurality of walls 46 is formed within the retractable access portion 22. The aperture 44 is so sized and shaped as to be capable of receiving a physical/electrical media connector. Formed within aperture 44 by means of walls 46 is a broad retention clip groove 48, a narrow retention clip groove 50, and a retention ridge 52. These structures within aperture 44 provide for the retention of a connector pin block of a physical/electrical media connector. A guide track 54 is formed within communications card 29 protruding upwardly from the bottom of communications card 29. Guide track 54 is interengaged with a corresponding guide groove formed in the bottom of retractable access portion 22.

When a user desires to connect a telephone line to the communications card, biased lever 40 is manipulated out of retention notch 38. As retractable access portion 22 is released from the grip of biased lever 40, tension applied by spring 34 urges retractable access portion 22 out of slot 32. The progress of retractable access portion 22 is guided by guide track 54 and is halted when biased lever 40 engages limiting notch 42. A user then inserts a physical/electrical media connector into aperture 44 to provide an electrical connection between communications card 29 and the telephone line. When a user no longer desires to access the retractable access portion 22, the user merely presses retractable access portion 22 back within the confines of the computer housing until the retention notch 38 is engaged by biased lever 40.

While the example as described has been effective as a media interface connection, safety precautions and requirements frequently emerge as products gain widespread public acceptance and safety consciousness increases. It is well known that public telephone transmission lines and electrical power transmission lines either share common conduction line supports such as "utility poles" or are adjacently positioned on individual utility poles. Additionally, both electrical and telephonic transmission lines are adjacently located as they enter into an end user's structure such as a home or business. As such, there exists the potential for both conduction lines to contact each other when in their conductive state thereby causing interruptive and dangerous conditions on the other's conduction lines. For example, telephonic lines, and in particular Public Switched Telephone Network (PSTN) lines, generally transmit signals using Direct Current (DC) signalling using approximately 48 volts with current levels around 120 m A or less. In contrast, electrical or power conduction services generally transmit power using Alternating Current (AC) techniques and utilize voltage signal levels of hundreds and even millions of volts with current levels in the hundreds to millions of amperes range. In the eventuality that both the electrical or power transmission lines were to contact the telephonic transmission lines, large and hence dangerous signal levels on the telephone lines could subject individuals and equipments such as modems and computers to injurious and fatal conditions.

Other potentially dangerous failure modes include spurious lines conditions that exceed expected transmission ranges. For example, the telephonic transmission lines of the PSTN system, as described above, accommodate a voltage in the range of 0–200 volts when the "ring voltage" is sent across the lines. Equipments such as communications cards are designed to accept such signal levels. However, when acts, including acts of nature such as lightning strikes, introduce transient conditions in excess of hundreds and even thousands and millions of volts that reach injurious levels for both humans and equipments.

To moderate such occurrences, requirements by safety agencies have been promulgated to manufactures of interface devices such as communication cards, including modem and network cards, to provide protection against injury and damage from such calamity. In many instances, the safety requirements are scheduled to be in place on communications cards by the year 2000. On such safety requirement dictates that end user equipment such as communication cards must provide a removable fusible link that will activate upon the occurrence of conditions commensurate with 600 volts and 40 amperes. Such requirements accommodate the typical operational conditions utilizing the PSTN standard and other similar defined standards. While the precise specifications of the safety requirements vary between countries and agencies, the general nature of the regulations includes providing a spurious line condition protection mechanism for the protection of both the human communications card end user as well as the communications card equipment itself.

Accordingly, it would be an advance to provide an improved electrical connection between the media connector, such as the telephone or network interface, and the communications card or communication or computing device that substantially provides the protection to both end users and the equipment itself as requested by safety regulations.

SUMMARY AND OBJECTS OF THE INVENTION

It is, therefore, an object of the present invention to provide an improved electrical connector for use between a media connector and a communications card or device that provides a safety mechanism to minimize potential injury and damage resulting from transient electrical conditions introduced by the media connector.

It is another object of the present invention to provide an improved electrical connector for use between a media connector and a communications card or device that economically complies with safety regulations requiring the incorporation of such a safety mechanism.

It is a further object of the present invention to provide an improved electrical connector for use between a media connector and a communications card or device that complies with safety concerns and consumes little or no physical space on a printed circuit board (PCB) housed internally within the communications card.

It is still a further object of the present invention to provide an improved electrical connector for use between a media connector and a communications card or device that complies with safety concerns and is replaceable or serviceable in the event the safety mechanism activates upon the occupance of the transient electrical conditions.

In accordance with the invention as embodied and broadly described herein, the foregoing and other objectives are achieved by providing an improved electrical connector in a communications card or device for use in interfacing between a media connector and a downsized computer or other communication device. In a preferred embodiment, the communications card comprises a retractable access portion and a fixed portion. The retractable access portion has an aperture formed therein configured to receive the media connector. A conductive terminal having a first and a second end mates with both the retractable access portion and the fixed portion. The first end makes electrical contact with the media connector while, simultaneously, the second end makes electrical contact with the fixed portion as the retractable access portion is extended beyond the computer housing during use. The second end may make electrical contact with the fixed portion either via sliding contacts formed on the second end accomplished by means of a conductive track disposed on the fixed portion, or alternatively through a flexible wire ribbon intermediarily connected between the second end of the conductive terminal and the fixed portion of the communications card. Since the fixed portion is in electrical communication with the computer, the media connector is also in electrical communication with the computer. The conductive terminal is further comprised of a mid-portion wherein the electrical safety mechanism is implemented. The fusible or capable of fusing mid-portion forms a fusible link through the deliberate "necking-down" of the conductive terminal to create a current restriction that fuses or opens when subjected to electrical conditions outside the prescribed safety specifications. A contact block may additionally be provided to align and electrically isolate the conductive track and the fusible link portion.

The present invention may be incorporated into an alternate implementation wherein an improved electrical connector is provided that is integral with the communication or computing device and is also capable of receiving a media connector. In such an embodiment, the improved connector is comprised of a retractable access portion having an aperture formed therein configured to receive a media connector. Conductive terminals within the retractable access portion have a first end and a second end that mate with the retractable access portion for conductively interfacing with the media connector and also for mating with a fixed portion which may be a printed wiring board or other integral portion of the communication device such as a computer motherboard or a printed wiring board of communication device. While the present embodiment may employ the sliding conductive terminals as described herein, such an implementation may also utilize a ribbon-wire cable for interfacing the conductive terminals with a fixed or printed wiring board portion of the communication device.

Alternatively, the mid-portion of the conductive terminal may implement the fusible link through the use of other fusing techniques and materials taking the form of a zig-zag or spiral fuse-element configuration as known by those of skill in the art. Additionally, the fusible link portion may be aligned and electrically isolated by a contact or pin block forming a frame around the mid-portion. In such an embodiment, a material such as silicone encapsulates the fusible link to contain the vaporization of the fusible link when the safety mechanism activates.

These and other objects and features of the present invention will become more fully apparent from the following description and appended claims, or may be learned by the practice of the invention as set forth hereinafter.

BRIEF DESCRIPTION OF THE DRAWINGS

In order to more fully understand the manner in which the above-recited and other advantages and objects of the invention are obtained, a more particular description of the invention will be rendered by reference to specific embodiments thereof which are illustrated in the appended drawings. Understanding that these drawings depict only typical embodiments of the invention and are not therefore to be considered to be limiting of its scope, the invention in its presently understood best mode for making and using the same will be described and explained with additional specificity and detail through the use of the accompanying drawings in which.

DETAILED DESCRIPTION OF THE PREFERRED EMBODIMENTS

In accordance with the present invention, an improved electrical connector is provided for use between a media connector and a communications card in a computer system. It is a feature of the present invention to provide a fusible link between the media connector and the PCB of the communications card to comply with safety regulations and provide a safety mechanism preventing injury to both the equipment such as the communications card and attached equipment (e.g., the host computer) and the communications card user.

As used herein, a "PCMCIA communications card" or "communications card" refers to a communications card falling within the memory card parameters defined by the Personal Computer Memory Card International Association having a thickness less than the thickness of a miniature modular jack physical/electrical media connector. Accordingly, a communications card also refers to PCMCIA architecture modem cards, PCMCIA architecture network cards, such as a LAN, or equivalents thereof.

As used herein, a "miniature modular jack physical/electrical media connector" or "media connector" connotes a media connector such as those connectors having physical attributes described in F.C.C. part 68, subpart F, expressly incorporated herein by reference. Specific media connectors such as a RJ-11 or a RJ-45 are merely references to a specific exemplary media connector falling within the broader parameters of the term "media connector" and should not be used to limit the scope of the present invention to specific connectors.

Figure 1:
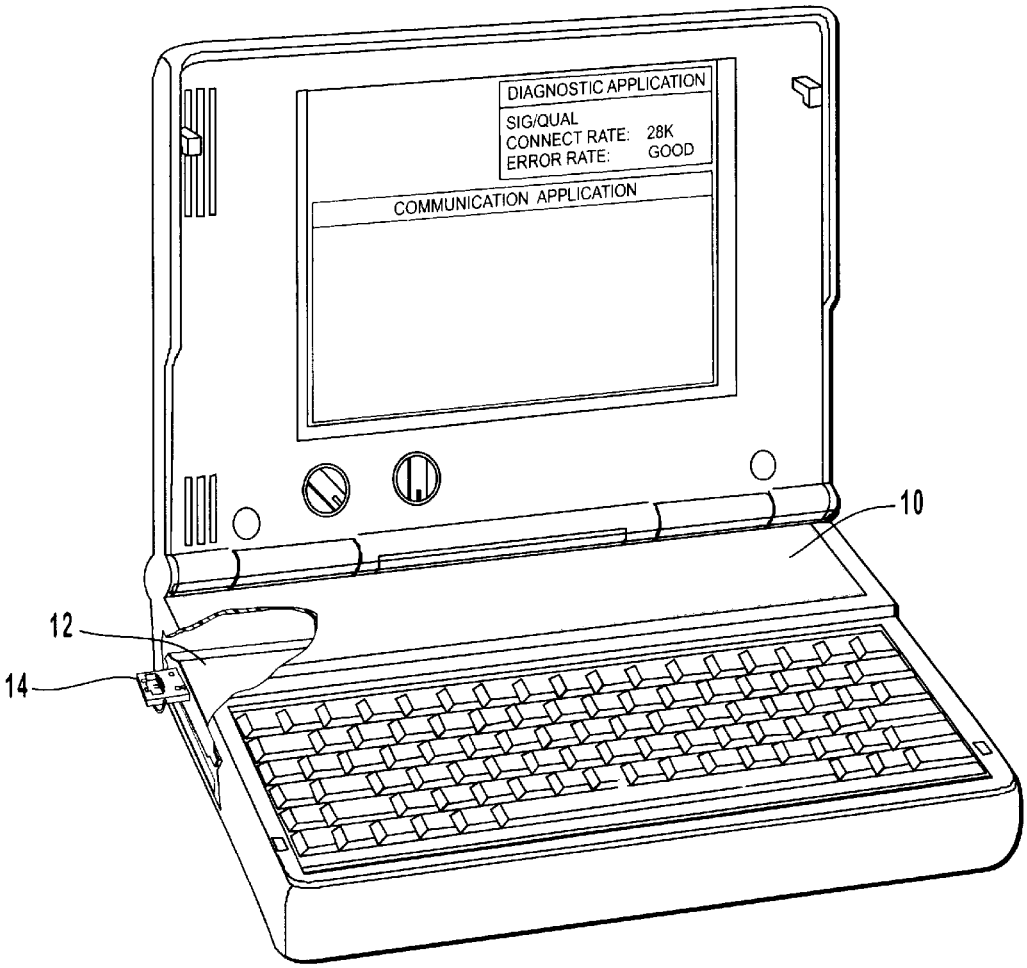
FIG. 1 (PRIOR ART)
FIG. 1 is a simplified depiction of a down-sized computer having a slot in which to receive a communications card capable of interfacing with a telephonic or network system via a media connector.
Figure 2:
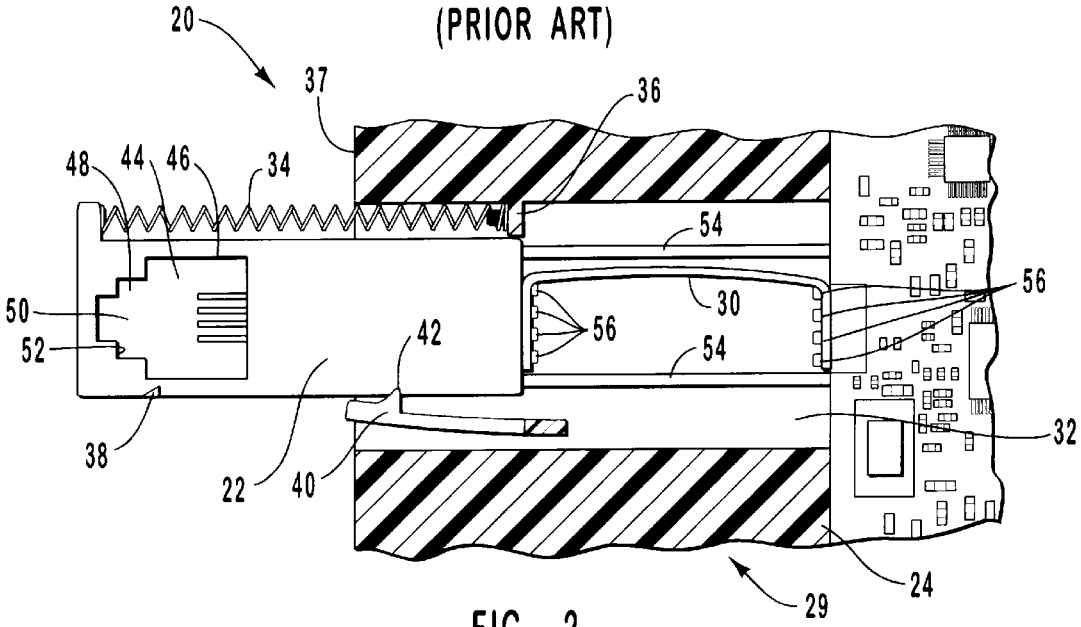
FIG. 2 (PRIOR ART)
FIG. 2 is a plan view of a prior art sliding interface device having an unfused electrical connection via a flexible wire ribbon for directly electrically coupling a received media connector with a communications card.
Figure 3:
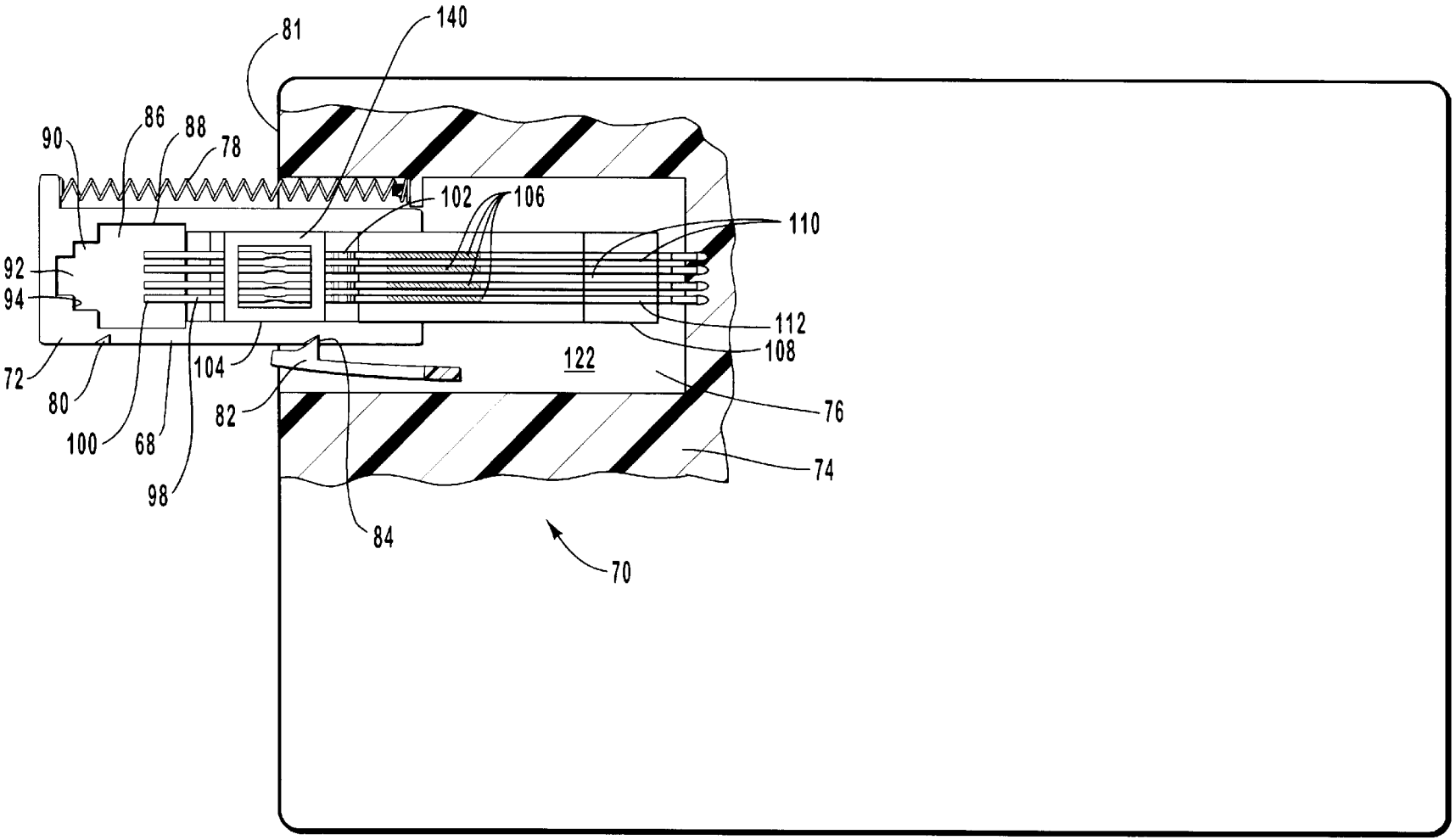
FIG. 3 is a plan view of a communications card in accordance with the present invention having a fusible link and a sliding interface electrical connector for fusibly electrically connecting a media connector with the communications card.

With reference to FIG. 3, a fusible sliding interface electrical connector in accordance with the present invention for ultimately providing a fused or fusible electrical communication between a media connector (not shown) and a computer (not shown) is depicted generally as 68. The sliding interface electrical connector 68 is defined by a communications card 70 having a retractable access portion 72 and a fixed portion 74.

The fixed portion 74 is in electrical communication with the computer by means of electronic circuitry connected on a printed circuit board (PCB) housed internally within the communications card 70. As used herein, fixed portion 74 shall refer to the generally stationary features internal to the communications card. Such features include, but are not limited to, the PCB, the electronic circuitry thereon, the mechanical spacers and connectors used to physically connect the PCB to the communications card. The retractable access portion 72 is in electrical communication with fixed portion 74 through the sliding interface electrical connector 68, described in detail below.

During use, in means well known in the art, the retractable access portion 72 slides in and out of a slot 76 formed within the fixed portion 74. The retractable portion 72 is urged out of the slot 76 by a spring 78 biased, in a direction external to the computer housing, by a ledge 79 connected to the fixed portion 74. Although not shown, the computer housing during use is substantially parallel to an edge 81 of the communications card 70. A limiting notch 84 engaged by a biased lever 82 is used to restrict the travel distance of the retractable access portion 72 to a predetermined distance when the retractable access portion is urged in a direction external to the computer housing by the spring 78. After use, a retention notch 80 in combination with the biased lever 82 is used to retain the retractable access portion 72 within the housing of the computer and the housing of the communications card. While the present embodiment depicts the travel of the retractable access portion 72 being governed by the use of biased lever 82 in conjunction with notches 80 and 84, other travel mechanisms are also equally operational that include the use of tumblers or other rocker assemblies that result in an engage/release mechanism employing the depression of the retractable access portion deeper into the fixed portion to engage/release the retractable access portion 72 from its previous state.

An aperture 86 having a plurality of walls 88 is formed within the retractable access portion 72. The aperture 86 is so sized and shaped as to be capable of receiving a media connector. Formed within aperture 86 by means of walls 88 is a broad retention clip groove 90, a narrow retention clip groove 92, and a retention ridge 94. These structures within aperture 86 provide for the retention of a connector pin block of a media connector.

When a user desires to connect a telephone line or similar network line to the communications card, biased lever 82 is manipulated out of retention notch 80. In a biased lever embodiment, as retractable access portion 72 is released from the grip of biased lever 82, tension applied by spring 78 urges retractable access portion 72 out of slot 76. The progress of retractable access portion 72 is guided by portions (defined later) of the fusible sliding interface electrical connector 68 and is halted when biased lever 82 engages limiting notch 84. A user then inserts at least a portion of a media connector into aperture 86 to provide an electrical connection between communications card 70 and the telephone or network line. When a user no longer desires to access the retractable access portion 72, the user merely presses retractable access portion 72 back within the confines of the computer housing until the retention notch 80 is engaged by biased lever 82.

However, it should be appreciated that even further biasing means, aperture embodiments for accepting a media connector during use and retention means for stabilizing the media connector, for example, are contemplated within the scope of the present invention and are more fully described in U.S. Pat. Nos. 5,183,404, 5,336,099 and 5,338,210. All three of these patents are expressly incorporated herein by reference.

The fusible sliding interface electrical connector 68 comprises fusible link 140 including a fusible pin block 96 and at least one conductive terminal or lead 98. In FIG. 3, four conductive leads being in substantially parallel arrangement are illustrated. Each conductive lead 98 has a first end 100 and a second end 102. It should be appreciated, however, that the conductive lead is preferably one singular conductive material and the first and second ends simply describe portions of the conductive lead 98 that extend beyond a boundary 104 of fusible pin block 96 on opposite sides thereof. Preferably, the conductive lead is inserted within and molded contiguously with the fusible pin block 96 in a well known manufacturing technique often referred to as "insert molding."

The first end 100 of the conductive lead 98 is for making electrical contact with the media connector during use when the media connector is inserted into aperture 86. Preferably, the first end 100 extends at least partially into the aperture 86 for electrically contacting the necessary conductors of the media connector. The necessary conductors of an RJ-11 media connector usually include the "tip and ring" lines.

The second end 102 of the conductive lead 98 is for slidingly making electrical contact with a conductive track 106. The conductive track 106 is an elongated conductive material of sufficient length that allows for a sliding electrical contact of the second end 102 throughout the range of motion as the retractable access portion is extended beyond the housing of the computer. The conductive track is preferably a metal, such as aluminum, copper, gold, silver, combinations thereof and similar other metals and metal combinations, but is not required to be. The conductive track 106 is also of sufficient length to maintain electrical contact with the second end even when the retractable access portion 72 is inadvertently bumped during use and caused to slide in a direction generally towards the computer. When this inadvertent sliding occurs, the retractable access portion 72 is only able to travel towards the computer housing until the media connector, inserted in the aperture 86, is prevented from further travel as it abuts against the computer housing. Thus, if the inadvertent sliding of the retractable access portion 72 remains as a possibility, the conductor tracks only need to be of a length sufficient to electrically contact the second end 102 when the retractable access portion is fully extended and when the media connector, during use, is pushed and abutted against the housing.

It should be appreciated that since the conductive track 106 is in electrical communication with the fixed portion 74 the second end 102 is simultaneously in electrical communication with the fixed portion 74. In turn, the first end 100 of the conductive lead 98 is also in electrical communication with the fixed portion 74. Thus, during use, when conductive lines of the media connector electrically contact the first end 100, the media connector is in electrical communication with the computer via the fixed portion 74.

A contact block 108 is provided to align the conductor tracks 106 and electrically isolate each conductor track from adjacent conductor tracks. Preferably, the conductor tracks 106 are towards a bottom of the contact block so that a plurality of barriers 110 protruding upwardly from the bottom 112 of the contact block can better serve to guide the second end 102 of the conductive terminal 98 as the second end 102 slides back and forth along the conductive track as the retractable access portion 72 is slid back and forth in slot 76. For descriptive purposes only, the barriers 110 can be loosely analogized to the gutters surrounding a bowling lane. In one embodiment, the contact block 108 is interengaged with a corresponding guide groove (not shown) formed in the bottom of retractable access portion 72 to facilitate the sliding back and forth of the retractable access portion.

Figure 4:
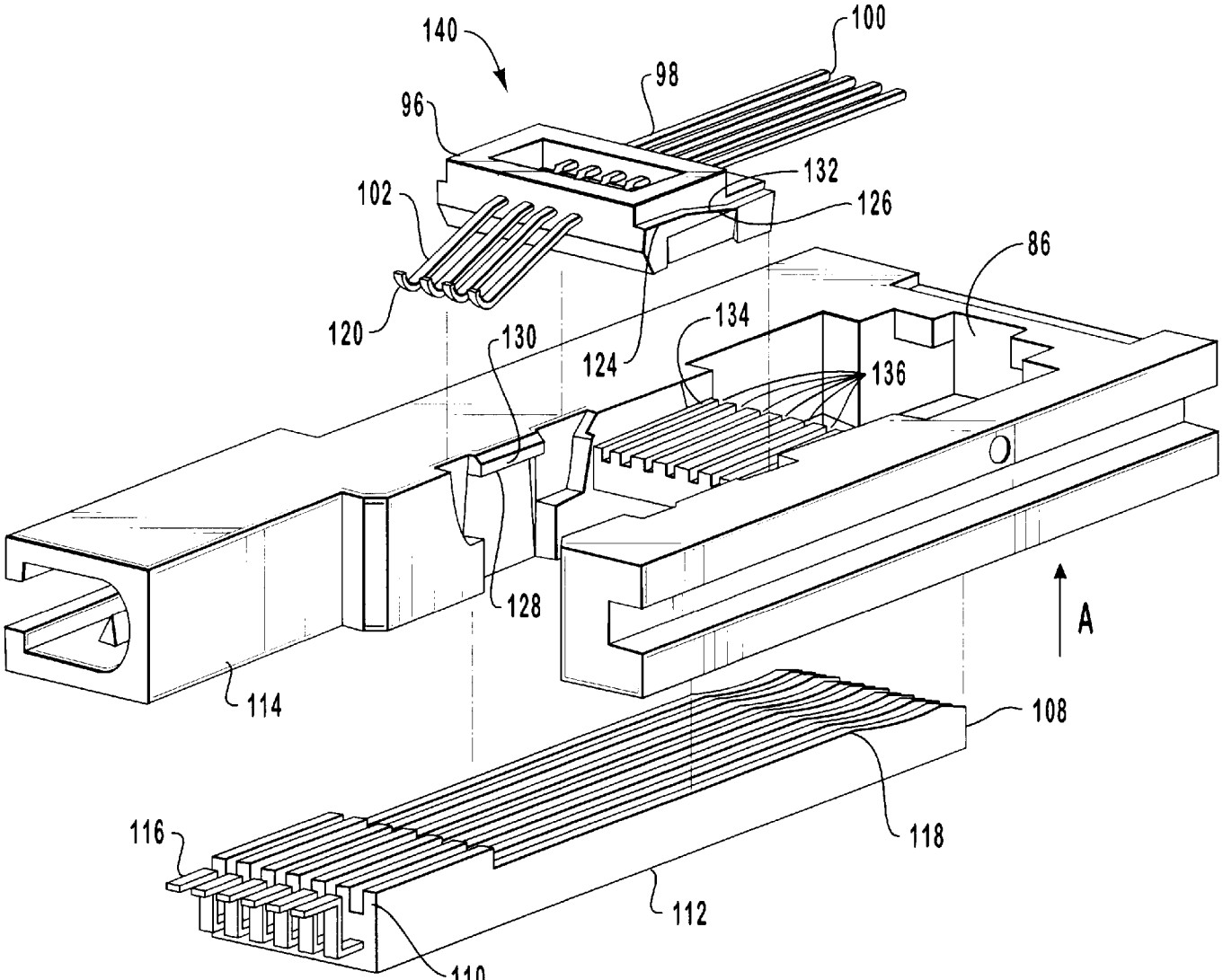
FIG. 4 is an exploded view of the fusible link and the sliding interface electrical connector of FIG. 3.

In another embodiment, the contact block 108 is isolated from the structure of the retractable access portion. For example, with reference to FIG. 4, the contact block 108 fits laterally within the frame 114 of the retractable access portion 72. In this embodiment, the contact block 108 electrically mates with the fixed portion 74 by leads 116 at one end of the contact block. The leads 116 are insert molded with the contact block and are in electrical communication with the conductor tracks 106 that are recessed between barriers 110.

During use, to facilitate the retraction of the retractable access portion 72 within the housing of the computer, the conductor tracks have a sloping portion thereof defined by the sloping contour 118 of the contact block at another end thereof. This allows the second end 102 of the conductive lead 98 to travel away from a bottom 112 of the contact block when the retractable access portion 74 is urged back into the communications card.

Also depicted in this embodiment is a generally "J" shaped, curved terminal portion 120 of the second end 102. In this manner, the curved terminal portion 120 more easily slides along the conductor tracks 106 which facilitates the sliding electrical contact therebetween. Moreover, since the curved terminal portion is not straight, there is less scraping of the conductive materials configured into the conductor tracks.

In one embodiment, the conductor tracks 106 are a palladium-nickel compound having a flash of gold deposited thereupon. This compound, commonly known as an "80-20 plating" beneficially reduces potential clogging of the contact block that might be caused by the gentle erosion of the gold flash of the conductor track as the second end 102 of the leads 98 scrapes there against over time. In general, since it is known that gold is "attracted" by palladium, as the gold flash is eroded by the movement of the second end of the conductive lead, the gold particles attach themselves to the palladium base and keeps the gold flash from sliding between barriers 110 during use.

In another embodiment, the contact block 108 can be configured specifically on the PCB of the fixed portion 74 instead of therebetween. In this manner, appropriately shaped second ends would need to be configured that extend from the pin block to the contact block. Such appropriately shaped second ends might include, but are not limited to, generally "L" shaped leads that extend straightward from the fusible pin block 96 and then sideways onto the PCB and the conductor tracks.

Figure 5:
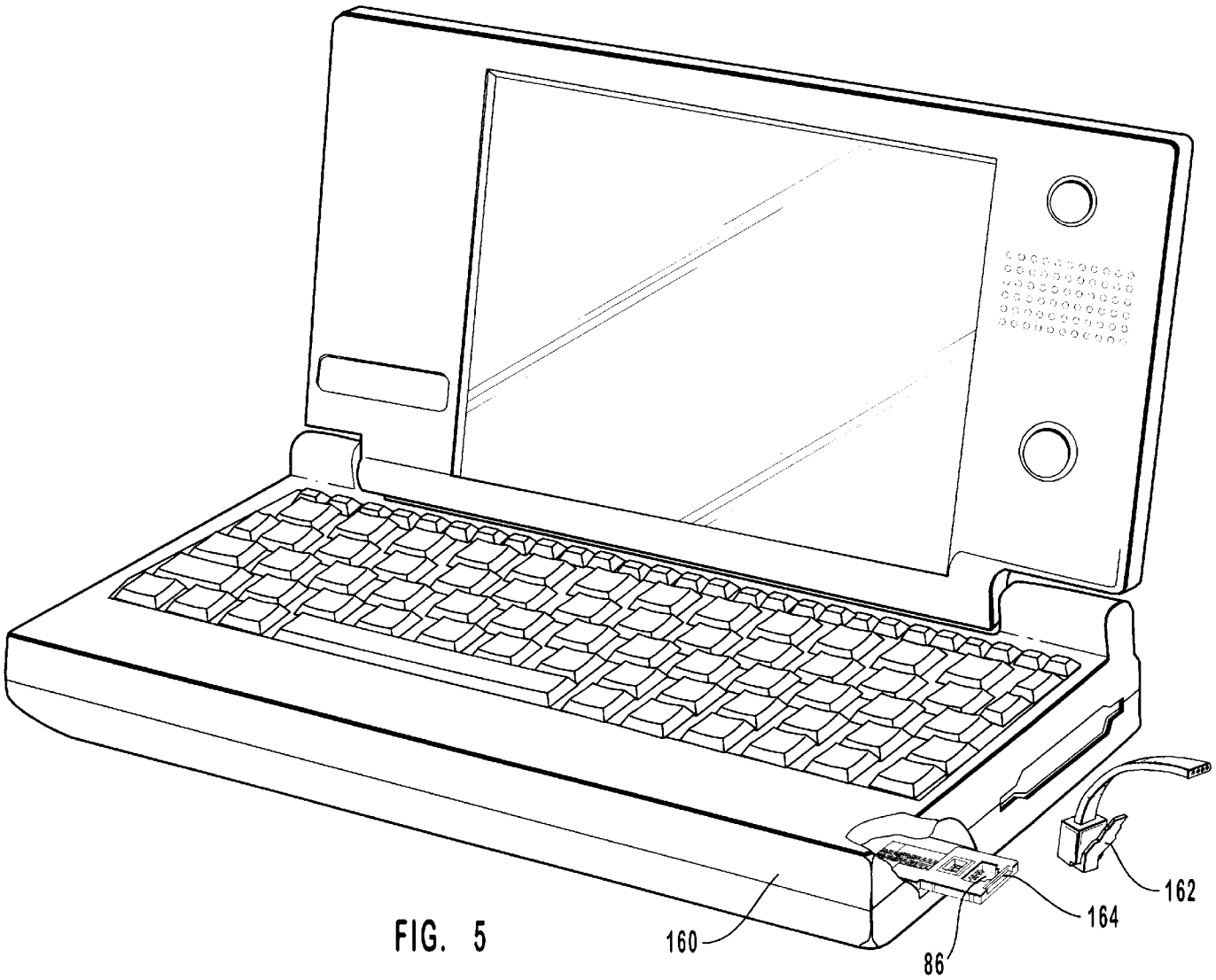
FIG. 5 is a view of a computing/communication device having the retractable access portion of the improved connector incorporated within the communication device, in accordance with an embodiment of the present invention.

FIG. 5 depicts an alternate embodiment of the improved connection system of the present invention wherein a retractable access portion 164 extends directly from a communication device 160 as opposed to the earlier embodiment wherein the retractable access portion extends from a communication card which in turn is inserted within a communication device. In the present embodiment, the fixed access portion of the connection system is integral to the internal electronic interconnection board. For example, the fixed access portion may be implemented on the motherboard of communication device 160 or, alternatively, may be implemented as a daughter board configuration which in turn interfaces with the host or motherboard of communication device 160.

Figure 6:
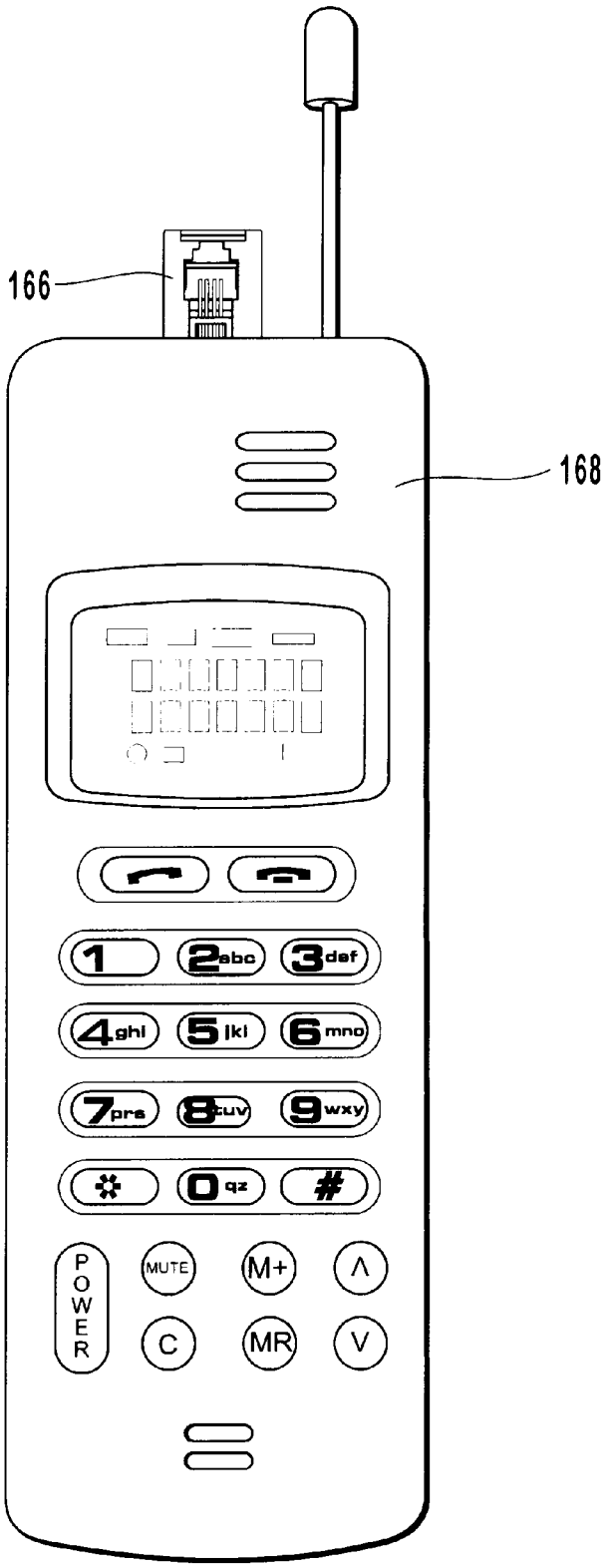
FIG. 6 is a simplified view of a communication device incorporating the improved connection system of the present invention wherein the retractable access portion is attached to a fixed portion which is integral with the communication device, in accordance with an embodiment of the present invention.

Additionally, while in the previous embodiment the retractable access portion interfaced with the fixed access portion via a sliding contact arrangement, an alternative approach employing a wire ribbon or other flexible interconnect approach is also feasible. It is contemplated that communication device 160 may take the form of independent communication devices such as additionally-integrated down-sized computers also known as sub-notebook personal computers, personal data assistants (PDA), pagers and other types of communication and computing devices known by those of skill in the art. Furthermore, in another embodiment as depicted in FIG. 6, a communication or computing device may take the form of a wireless transceiver 168. In such an implementation a retractable access portion 166 when retracted conforms with the dimensions of wireless transceiver 168. When retractable access portion 166 is extended from wireless transceiver 168, the aperture and the plurality of conductive terminals having the fusible link are exposed and capable of receiving a media connector.

In one embodiment, the fusible link 140 as illustrated in FIG. 5 is comprised of the fusible pin block 96 and at least one conductive terminal 98. The conductive terminals 98 are appropriately spaced to accommodate compatible mating with a connector pin block of a received media connector. To facilitate the proper spacing of conductive terminals 98, the fusible pin block 96 can be implemented as a support frame comprised of two perpendicular frame members 142 for maintaining the proper spacing the conductive terminals 98 and two parallel frame members 144 for maintaining the appropriate spacing between the perpendicular frame members 142. The support frame forming the fusible pin block 96 can be implemented wherein the perpendicular and parallel frame members, 142 and 144, respectively, are manufactured as a continuous injection molded piece with the conductive terminals 98 integrally molded therein.

Alternatively, the support frame of fusible pin block 96 may be comprised of top and bottom halves that fit together around the conductive terminals following the insertion thereof The fusible pin block 96 support frame can be manufactured from various dielectric material and preferably is comprised of insulative plastic. Other specific implementations of the fusible pin block 96 may be employed including those that receive the conductive terminals 98 in a slide-in manner with the fusible pin block having a snapping or fastening position for attaching to the retractable access portion 72 (FIG. 3) of the communications card.

To facilitate the fusing action of fusible link 140, in a preferred embodiment, the conductive terminals 98 are coined or pressed thin at a mid-portion 146 of conductive terminals 98. In the preferred embodiment, the mid-portion 146 of conductive terminals 98 is coined to a thickness of approximately 0.001 inches, although other thicknesses may be accommodated depending upon the malleability and conductivity of the metallic makeup of conductive terminals 98. Coining can be performed using a press or other casting operation that assists in the process of forming a current-reduction path through the conductive terminal 98. While the coining process may occur either before or after the conductive terminals are installed within the frame of fusible pin block 96, when performed following the insertion therein, the fusible pin block 96 provides additional support for the thickness-reduced mid-portion 146 of the conductive terminals 98.

As illustrated in FIG. 6, to complete the fusing capability of fusible link 140, an excess portion 148 of the coined region of the mid-portion 146 of conductive terminal 98 is trimmed to neck-in the mid-portion 146 of the conductive terminal 98 to form a fuse region 150 having a dimension consistent with the current restriction requirements of the specific targeted safety regulation. In the preferred embodiment, the fuse region 150 fuses or open circuits, usually through vaporization at a regulation specification of 40 amperes and 600 volts.

The mid-portion 146 of conductive terminals 98 is arranged so as to be encompassed by the frame of the fusible pin block 96. Such an arrangement enables the first end 100 (FIG. 3) of conductive terminal 98 and the second end 102 (FIG. 102) of conductive terminal 98 to remain supported and spaced following the fusing of conductive terminal 98 at the mid-portion 146. The frame arrangement of fusible pin block 96 may assume other configurations or may be integrally injection molded about the conductive terminals 98.

Those skilled in the art appreciate that when a fuse such as fusible link 140 activates, the metal portion of conductive terminal 98 in the fuse region 150 vaporizes thereby opening the electrical circuit previously closed via fuse region 150. During the fusing mode of a fuse, the metal conductor turns to a plasma, thereby opening the circuit. Such plasma can generally ignite most polymers if there is sufficient oxygen and electric current available to sustain the arc. Although the vaporization opens the circuit protecting upstream electrical components from damage due to the spurious signal levels, the vaporized metal from fuse region 150 may cause contamination and induce other failure modes in adjacent conductive terminals 98 as well as other components.

Figure 7:
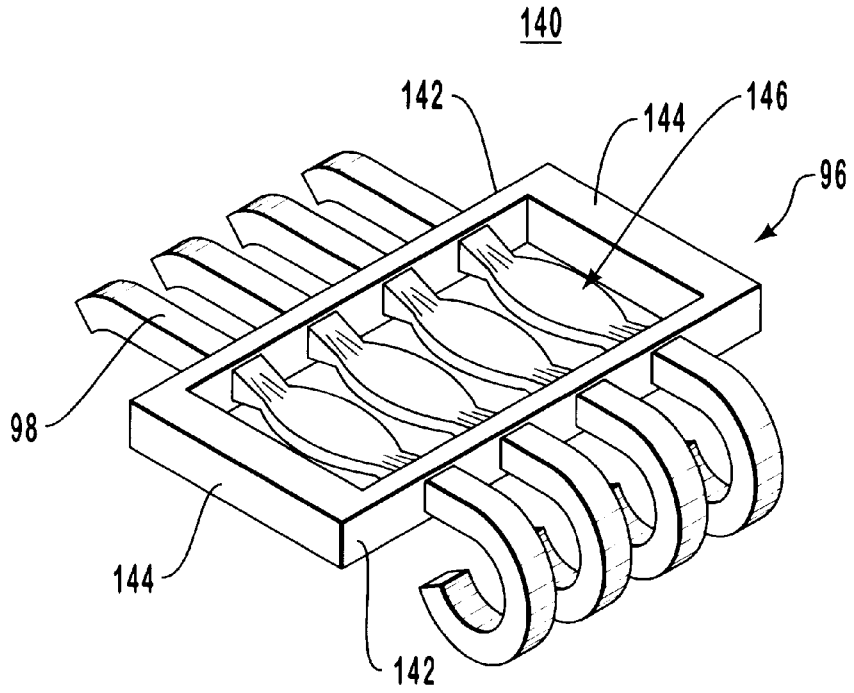
FIG. 7 is an isolated view of the pin block incorporating the fusible link of the present invention.

Generally, fuses are provided with a ceramic or glass enclosure which contains or encapsulates the plasma arc. To mitigate the deleterious effects from such metallic vapors, an encapsulation of the fuse region 150 is preferred. In FIG. 7, an encapsulation barrier 152 is provided to contain the metallic plasma from contaminating adjacent circuitry. In the preferred embodiment, the encapsulation barrier 152 is comprised of a silicon-based substance since silicon behaves quite similar to glass or ceramics. Due to the high amount of the silicon in the molecular structure, the silicon-based encapsulation barrier 152 does not ignite and can contain the plasma flash.

In the preferred embodiment, the silicon-based encapsulation barrier 152 may be applied through various techniques which include molding, potting or other techniques known by those skilled in the art. Alternatively, to provide additional assurances of isolation between adjacent circuitry and structure, a supplemental barrier 154 may be inserted through injection or other manufacturing methods to increase and augment the encapsulation between the fuse region 150 of one conductive terminal 98 and other ones of conductive terminals 98. Such material forming the supplemental barrier 154 are also preferably of a silicon base and may even be comprised of the same material as the encapsulation barrier 152.

Figure 8:
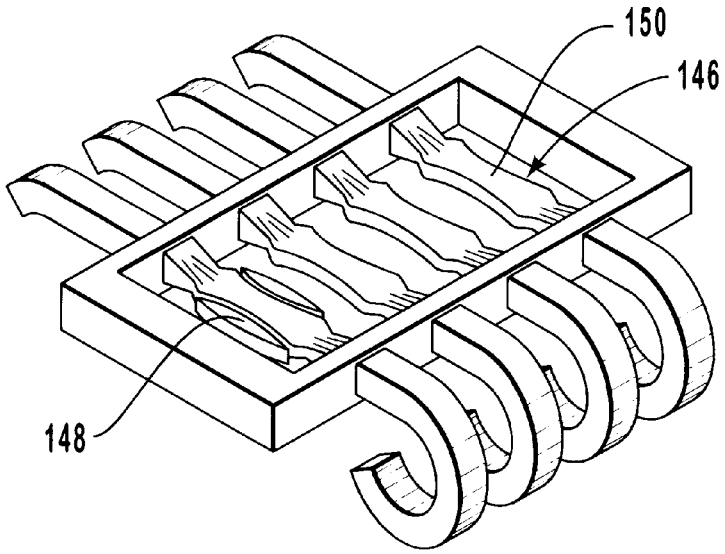
FIG. 8 is an isolated view of the mechanical processing of a conductive terminal to form a fusible link, in accordance with one embodiment of the present invention.
Figure 9:
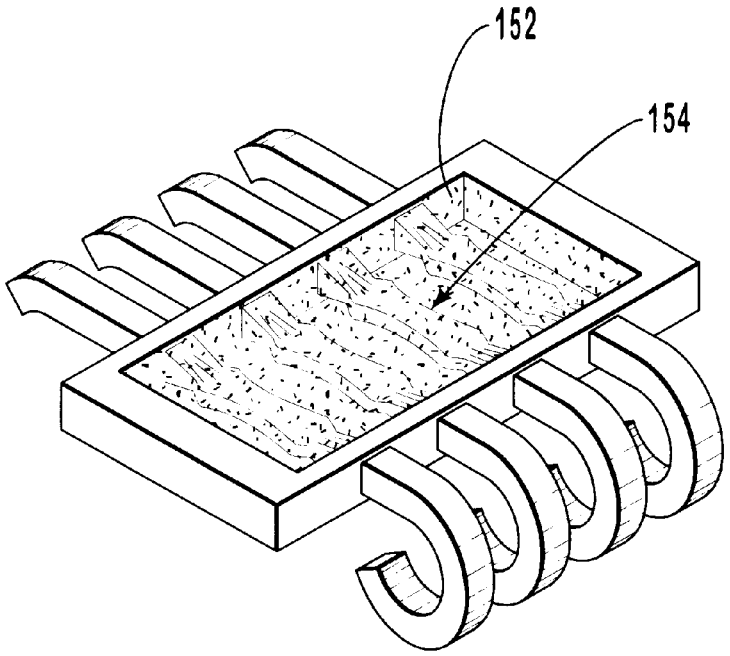
FIG. 9 is an isolated view of the fusible pin block which is additionally encapsulated to prevent contamination and complications by the vaporized fusible link upon activation of the safety mechanism of the present invention, in accordance with the preferred embodiment of the present invention.
Figure 10:
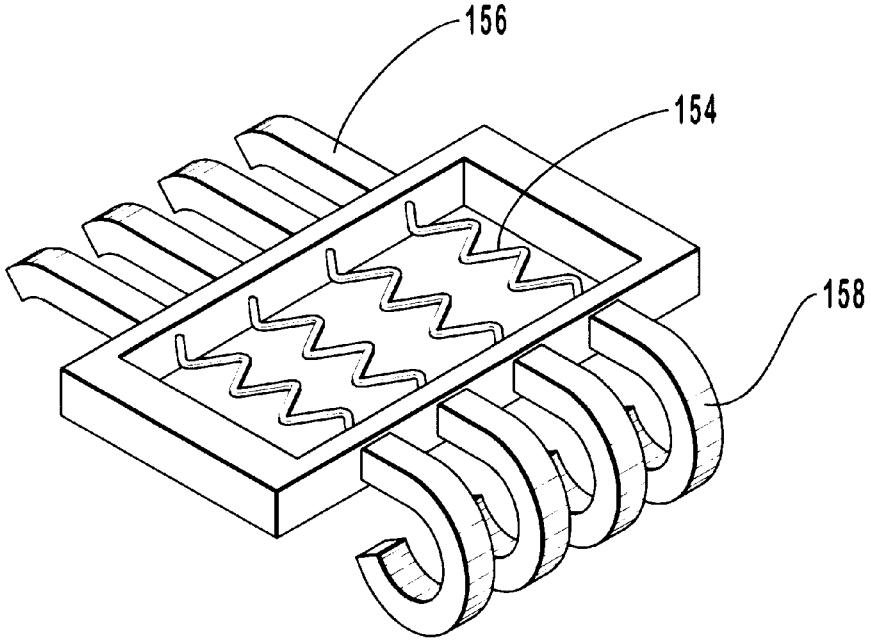
FIG. 10 is an isolated view of the fusible pin block having a fuse region implemented with a fuse region created from separate fuse material, in accordance with an alternate embodiment of the present invention.

While the fusible link of the present embodiment has been described having a fuse region manufactured by coining and trimming the conductive terminal to create the requisite electrical current limiting properties, other fusing techniques may also be employed. For example, in FIG. 8, a conductive terminal is illustrated wherein the mid-portion of the conductive terminal is comprised of a separate conductive material forming a fuse region 154 and having the desired fusing properties to provide the desired current limiting capabilities. Such a fusing approach generally incorporates a wire-like material that is soldered or otherwise electrically attached with the first and second ends of the conductive terminal which are then separate conductive terminals 156 and 158 and are electrically joined by the different fuse portion forming the fuse region 154 of the fusible link. Those skilled in the art appreciate the processes associated with attaching the fuse region 154 with the conductive terminals 156 and 158 to form the fusible link of this alternate embodiment.

It should be appreciated that the fusible link of the present invention accommodates the safety concerns of protecting both individuals and equipment from the eventuality of transient conditions that could prove destructive without invoking onerous design modifications to a communications card and requiring additional board space and volume requirements for the introduction of such a safety mechanism. It should be appreciated that modifications to the invention including different fuse-creation techniques and structural support techniques for supporting and spacing the conductive terminals, as well as encapsulation and insulation techniques are contemplated within the scope of the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A communications card for use in fusibly interfacing between a media connector and a downsized computer, comprising:

a. a fixed portion being capable of making electrical contact with said downsized computer during use;

b. a retractable access portion having an aperture formed therein configured to receive at least a portion of said media connector; and c. a fusible link having at least one conductive terminal with a first end and a second end, said first end for making electrical contact with said media connector during use and said second end for making electrical contact with said fixed portion during use as said retractable access portion is extended.

2. The communications card as recited in claim 1, further comprising a conductive track for slidingly making electrical contact with said second end of said conductive terminal during use as said retractable access portion os extended, said conductive track being in electrical communication with said fixed portion.

3. The communications card as recited in claim 1, wherein said fusible link is comprised of a fusible pin block having said conductive terminal including said first end and said second end passing therethrough, said conductive terminal further including a mid-portion forming a fuse region.

4. The communications card as recited in claim 3, wherein said pin block is comprised of a frame enclosing said fuse region to provide spacing and support about said mid-portion of said conductive terminal.

5. The communications card as recited in claim 3, wherein said fuse region of said fusible pin block is contiguous with said first end and said second end of said conductive terminal, said fuse region resulting from coining and trimming of said conductive terminal resulting in an electrical current restrictive region of said fusible link.

6. The communications card as recited in claim 3, wherein said first end of said conductive terminal and said second end of said conductive terminal are physically separated and said fuse region of said fusible pin block is comprised of a thin wire fuse material having a first end electrically coupled to said first end of said conductive terminal and a second end electrically coupled to said second end of said conductive terminal resulting in an electrical current restrictive region of said fusible link.

7. The communications card as recited in claim 4, wherein said fusible pin block further comprises an encapsulation barrier bounded by said frame for encapsulating said fuse region of said conductive terminal to contain metallic plasma generated when said fusible link activates.

8. The communications card as recited in claim 7, wherein said fusible pin block comprises a plurality of conductive terminals, said fusible pin block further comprising a supplemental barrier located between said fuse region of each of said plurality of conductive terminals to contain said metallic plasma generated by one of said conductive terminals when said fusible link activates from contaminating others of said plurality of conductive terminals.

9. A fusible direct connection system for removably engaging a media connector with a communications card, comprising:

a. a communications card having a retractable access portion and a fixed portion, said fixed portion being capable of making electrical contact with said downsized computer during use;

b. an aperture formed in said retractable access portion configured to receive at least a portion of said media connector; and c. a fusible link having at least one conductive lead having a first end and a second end, said first end extending partially into said aperture for making electrical contact with said media connector during use and said second end for making electrical contact with said fixed portion during use as said retractable access portion is extended.

10. The fusible direct connection system for removably engaging a media connector with a communications card as recited in claim 9, further comprising a conductive track for slidingly making electrical contact with said second end of said conductive terminal during use as said retractable access portion os extended, said conductive track being in electrical communication with said fixed portion.

11. The fusible direct connection system for removably engaging a media connector with a communications card as recited in claim 9, wherein said fusible link is comprised of a fusible pin block having said conductive terminal including said first end and said second end passing therethrough, said conductive terminal further including a mid-portion forming a fuse region.

12. The fusible direct connection system for removably engaging a media connector with a communications card as recited in claim 11, wherein said pin block is comprised of a frame enclosing said fuse region to provide spacing and support about said mid-portion of said conductive terminal.

13. The fusible direct connection system for removably engaging a media connector with a communications card as recited in claim 11, wherein said fuse region of said fusible pin block is contiguous with said first end and said second end of said conductive terminal, said fuse region resulting from coining and trimming of said conductive terminal resulting in an electrical current restrictive region of said fusible link.

14. The fusible direct connection system for removably engaging a media connector with a communications card as recited in claim 11, wherein said first end of said conductive terminal and said second end of said conductive terminal are physically separated and said fuse region of said fusible pin block is comprised of a thin wire fuse material having a first end electrically coupled to said first end of said conductive terminal and a second end electrically coupled to said second end of said conductive terminal resulting in an electrical current restrictive region of said fusible link.

15. The fusible direct connection system for removably engaging a media connector with a communications card as recited in claim 12, wherein said fusible pin block further comprises an encapsulation barrier bounded by said frame for encapsulating said fuse region of said conductive terminal to contain metallic plasma generated when said fusible link activates.

16. The fusible direct connection system for removably engaging a media connector with a communications card as recited in claim 15, wherein said fusible pin block comprises a plurality of conductive terminals, said fusible pin block further comprising a supplemental barrier located between said fuse region of each of said plurality of conductive terminals to contain said metallic plasma generated by one of said conductive terminals when said fusible link activates from contaminating others of said plurality of conductive terminals.

17. A communications card for use in fusibly interfacing between a media connector and a computer, comprising:

a. a retractable access portion having an aperture formed therein configured to receive at least a portion of said media connector;

b. a fixed portion having a printed circuit board, said printed circuit board being capable of making electrical contact with said computer during use;

c. a fusible link having a plurality of conductive terminals being pivotably mounted with said retractable access portion, each said conductive terminal having a first end and a second end, each said first end for pivotably making electrical contact with said media connector during use; and d. a plurality of conductive tracks for slidingly making electrical contact with each said second end of said conductive terminals during use as said retractable access portion is extended beyond a housing of said computer, said conductive tracks being in electrical communication with said printed circuit board.

18. The communications card for use in fusibly interfacing between a media connector and a computer as recited in claim 17, wherein said fusible link is comprised of a fusible pin block having said conductive terminal including said first end and said second end passing therethrough, said conductive terminal further including a mid-portion forming a fuse region.

19. The communications card for use in fusibly interfacing between a media connector and a computer as recited in claim 18, wherein said fuse region of said fusible pin block is contiguous with said first end and said second end of said conductive terminal, said fuse region resulting from coining and trimming of said conductive terminal resulting in an electrical current restrictive region of said fusible link.

20. The communications card for use in fusibly interfacing between a media connector and a computer as recited in claim 18, wherein said first end of said conductive terminal and said second end of said conductive terminal are physically separated and said fuse region of said fusible pin block is comprised of a thin wire fuse material having a first end electrically coupled to said first end of said conductive terminal and a second end electrically coupled to said second end of said conductive terminal resulting in an electrical current restrictive region of said fusible link.

21. The communications card for use in fusibly interfacing between a media connector and a computer as recited in claim 18, wherein said pin block is comprised of a frame enclosing said fuse region to provide spacing and support about said mid-portion of said conductive terminal.

22. The communications card for use in fusibly interfacing between a media connector and a computer as recited in claim 21, wherein said fusible pin block further comprises an encapsulation barrier bounded by said frame for encapsulating said fuse region of said conductive terminal to contain metallic plasma generated when said fusible link activates.

23. The communications card for use in fusibly interfacing between a media connector and a computer as recited in claim 20, wherein said fusible pin block comprises a plurality of conductive terminals, said fusible pin block further comprising a supplemental barrier located between said fuse region of each of said plurality of conductive terminals to contain said metallic plasma generated by one of said conductive terminals when said fusible link activates from contaminating others of said plurality of conductive terminals.

24. A fusible direct connection system for removably engaging a media connector with a communications device, comprising:

a. a retractable access portion having an aperture formed therein configured to receive at least a portion of said media connector;

b. a fixed portion integral with said communications device for providing physical and facilitating electrical contact between said retractable access portion and said communications device during use; and c. a fusible link having at least one conductive lead further having a first end and a second end, said first end extending partially into said aperture for making electrical contact with said media connector during use and said second end for making electrical contact with said fixed portion during use as said retractable access portion is extended from said communications device.

25. The fusible direct connection system for removably engaging a media connector with a communications device as recited in claim 24, wherein said fusible link is comprised of a fusible pin block having said conductive terminal including said first end and said second end passing therethrough, said conductive terminal further including a mid-portion forming a fuse region.

26. The fusible direct connection system for removably engaging a media connector with a communications device as recited in claim 24, further comprising a conductive track for slidingly making electrical contact with said second end of said conductive terminal during use as said retractable access portion os extended, said conductive track being in electrical communication with said fixed portion.

27. The fusible direct connection system for removably engaging a media connector with a communications device as recited in claim 25, wherein said pin block is comprised of a frame enclosing said fuse region to provide spacing and support about said mid-portion of said conductive terminal.

28. The fusible direct connection system for removing a media connector with a communications device as recited in claim 27, wherein said fusible pin block further comprises an encapsulation barrier bounded by said frame for encapsulating said fuse region of said conductive terminal to contain metallic plasma generated when said fusible link activates.

29. The fusible direct connection system for removably engaging a media connector with a communications device as recited in claim 28, wherein said fusible pin block comprises a plurality of conductive terminals, said fusible pin block further comprising a supplemental barrier located between said fuse region of each of said plurality of conductive terminals to contain said metallic plasma generated by one of said conductive terminals when said fusible link activates from contaminating others of said plurality of conductive terminals.

30. The fusible direct connection system for removably engaging a media connector with a communications device as recited in claim 25, wherein said fuse region of said fusible pin block is contiguous with said first end and said second end of said conductive terminal, said fuse region resulting from coining and trimming of said conductive terminal resulting in an electrical current restrictive region of said fusible link.

31. The fusible direct connection system for removably engaging a media connector with a communications device as recited in claim 25, wherein said first end of said conductive terminal and said second end of said conductive terminal are physically separated and said fuse region of said fusible pin block is comprised of a thin wire fuse material having a first end electrically coupled to said first end of said conductive terminal and a second end electrically coupled to said second end of said conductive terminal resulting in an electrical current restrictive region of said fusible link.

* * * * *